United States Patent [19]

Podrini

[11] Patent Number: 4,518,474

[45] Date of Patent: May 21, 1985

[54] DEVICE FOR THE ELECTROLYTIC TREATMENT OF METAL STRIP

[76] Inventor: Maurizio Podrini, Via Castel del Rio n. 9, 00127 Roma, Italy

[21] Appl. No.: 607,446

[22] Filed: May 7, 1984

[30] Foreign Application Priority Data

May 16, 1983 [IT] Italy ..... 48300 A/83

[51] Int. Cl.[3] ..... C25D 17/00

[52] U.S. Cl. ..... 204/206

[58] Field of Search ..... 204/206, 275

[56] References Cited

U.S. PATENT DOCUMENTS

| | | | |
|---|---|---|---|
| 2,392,687 | 1/1946 | Nachtman | 204/206 |
| 3,650,935 | 3/1972 | Andersson | 204/206 |
| 3,865,701 | 2/1975 | Borgmann | 204/206 |

FOREIGN PATENT DOCUMENTS

| | | | |
|---|---|---|---|
| 18167 | 6/1978 | Japan | 204/206 |

*Primary Examiner*—Thomas Tufariello

*Attorney, Agent, or Firm*—Young & Thompson

[57] ABSTRACT

A device for the continuous electrolytic treatment of metal strip, in which the elementary electrolytic treatment cell consists of a hollow chamber of rectangular section through which the strip to be treated passes. Insoluble electrodes are disposed on both larger faces of the chamber, the electrical circuit being closed through the metal strip to be treated. The cell is immersed in the electrolyte, and the electrolyte is forced to flow through the treatment chamber by an ejector at the entry end of the chamber, which faces against the direction of strip movement. The treatment chamber is open at both ends to the free flow of electrolyte therethrough.

1 Claim, 3 Drawing Figures

DEVICE FOR THE ELECTROLYTIC TREATMENT OF METAL STRIP

DESCRIPTION

The present invention relates to a device for the electrolytic treatment of metal strip and, more specifically, to a cell for electrolytic treatment and for the deposition of metal and/or non-metal coatings on metal strip, for example steel strip.

There is a generally recognised trend, due essentially to the need to increase the useful life of products made of metal strip, and particularly of steel strip, to produce strip coated on one or both sides by metals, metal alloys or metal compounds which protect the strip, and therefore the products manufactured from it, from corrosion.

Such coatings may be produced, essentially, in one of two ways: either by immersion of the strip in a bath of molten metal or alloy, or electrolytically.

Both coating techniques have advantages and disadvantages. Electroplating makes it possible to produce coatings which could not be obtained by other means, such as those with alloys whose components differ greatly in melting point, or with oxides or other compounds which are difficult to melt or which decompose when hot. On the other hand, it does not generally produce thick coating when used at industrial speeds. This happens because the electrolyte near the strip is depleted of metal ions as as result of the electrolytic deposition, so that there is a fall in current efficiency and consequently the morphology of the coating is not good and more gas develops; furthermore, the gases released in the electrolytic process, oxygen at the anodes and hydrogen at the cathodes, adhere to the electrodes and produce physical defects in the coating, causing a decrease in the treatment current.

To minimise these defects, it is necessary to work with a relatively low current density, unless very long treatment times, which are not economical industrially, are used.

Nevertheless electrochemical deposition has so many advantages that a great deal of effort has been made to overcome the problems described above.

Recently an extremely simple method has been proposed and put into effect. This consists of continuously supplying fresh solution to the strip and eliminating the gases by forcing the electrolyte to move at a given speed in counter current with respect to the strip being treated.

The foregoing is achieved through a cell of rectangular section containing insoluble anodes. The strip passes through the cell at the same distance from both anodes and functions as a cathode. The electrolyte is pumped into the cell at the opposite end from the end the strip enters and flows through the cell at high speed in the opposite direction from the strip.

In this way it is possible to rapidly obtain coating thicknesses much greater than those obtained with conventional electrolytic techniques, and in some cases comparable to those obtained by hot dipping methods.

The present invention relates to this topic, proposing a device for electroplating using high current densities which is simple, compact, and advantageous in comparison with similar known devices.

According to the present invention, an ejector device is placed in an electroplating cell. This cell is in the form of a chamber with flat rectangular cross section and containing insoluble anodes which form the larger planar faces within said cell, with the metal strip to be coated running in the centre of the chamber with its faces parallel to the surface of the said insoluble anodes. The ejector device is placed at the end of said cell the metal strip enters.

This ejector device supplies 10–40% of the amount of electrolyte needed for the electroplating in the direction opposite to that in which the metal strip moves.

Said cell is inserted in a tank and is immersed in the electrolyte.

As a result of the injection of the electrolyte by means of said ejector device, within the terminal part of said electroplating cell, more electrolyte is sucked into the cell from its opposite extremity, thus producing the desired counterflow of metal strip and electrolyte.

The present invention will now be described in relation to one embodiment of it. This is described purely as an example and is not limiting, as per the attached drawings in which.

Figure 3:
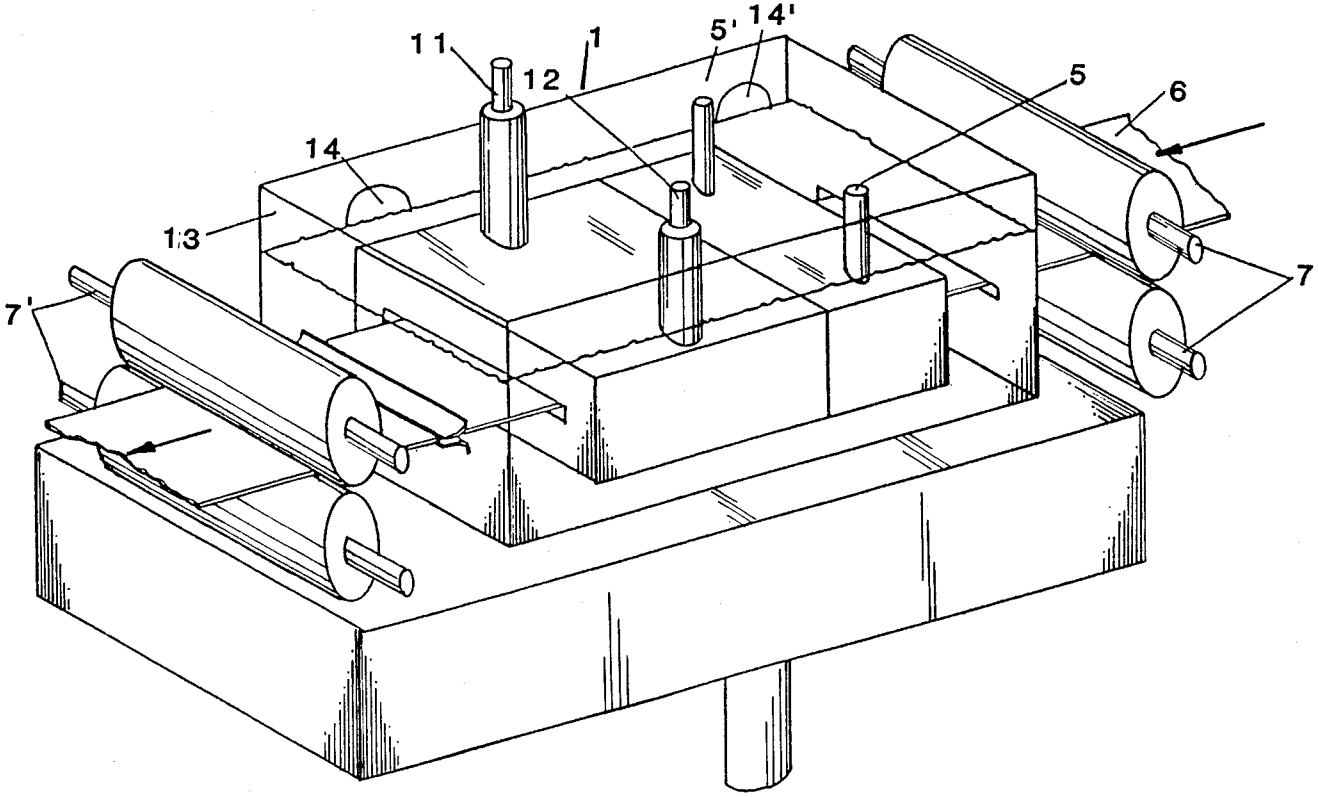

FIG. 3 provides a schematic perspective view of the entire device.

Figure 1:
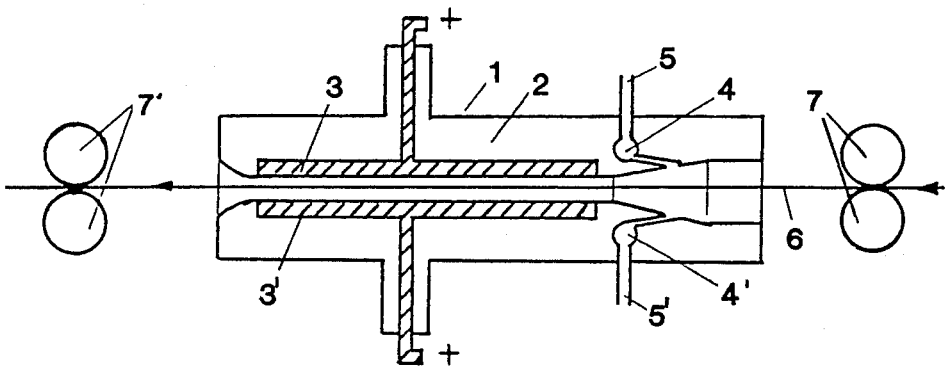
FIG. 1 shows a schematic view of a section of the electroplating cell.

With reference to FIG. 1, the cell, 1, in the form of an elongated horizontal hollow chamber, open at its ends, is composed of a shell, 2, carrying the anodes 3 and 3' on its inner surface. These anodes constitute the larger inner faces of the electroplating chamber.

The metal strip to be coated, 6, which functions as a cathode, passes through said electroplating cell from right to left in the figure and is held in position by two pairs of rollers 7 and 7' at the entry and exit points of said chamber, respectively.

The ejector device is at the entry end of said chamber and the electrolyte is conveyed through the ducts 5 and 5' and fed through the distribution chambers 4 and 4'.

Figure 2:
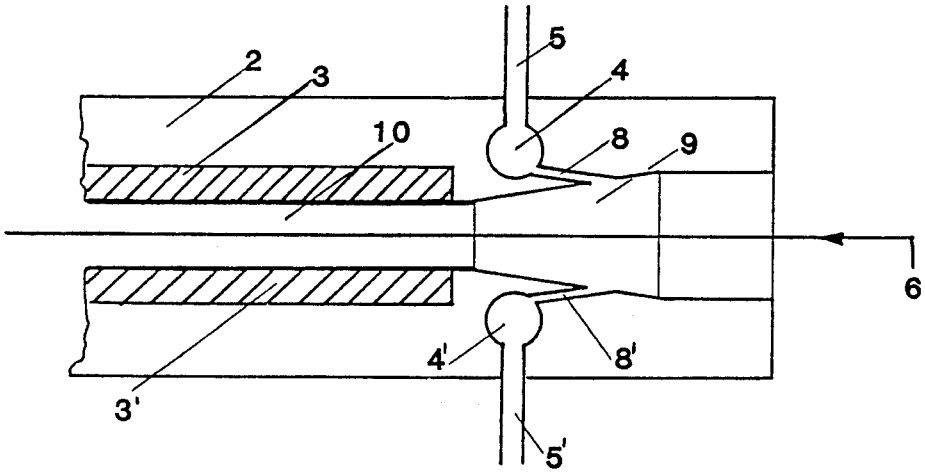
FIG. 2 shows a schematic view of the section of the ejector device.

The ejector is shown in greater detail in FIG. 2.

The electrolyte, pumped through the ducts 5 and 5', is distributed by the chambers 4 and 4', flowing through the slits 8 and 8' into the chamber 9, producing a depression which draws the electrolyte from the chamber 10.

FIG. 3 shows an overall view of the device of the invention.

The cell 1 is inserted into a bath 13 and immersed in electrolyte. The insulated conductors 11 and 12 take current to the upper and lower anodes while the ducts 5 and 5' convey the electrolyte under pressure to the end of the cell the strip enters.

With this device the fresh electrolyte pumped through the ejector performs the dual functions of drawing more electrolyte into the treatment chamber and renewing within the tank the solution leaving it from discharge points 14 and 14'.

The extreme simplicity of the device to which the present invention relates is obvious.

Using it, it is possible to obtain velocities of the electrolyte in the range of 0.5 to 3.0 m/s inside the electroplating chamber, thus enabling the thickness of the coating to be regulated very simply.

As indicated previously, the present invention lends itself to a great number of possible electrolytic and electroplating treatments with metals, alloys and compounds.

By suitably combining a given number of cells, all identical, it is possible to carry out cleaning and pickling treatment of the strip as well as to apply multi-layer coatings of different compounds and metals.

Some of these possibilities are described in the following examples.

EXAMPLE 1

The device according to the present invention is used for neutral electrolytic pickling of hot rolled strip subjected to mechanical scale-breaking treatment by known methods.

In this application the fixed electrodes are of mild steel for the anodic cells and of lead or lead-coated steel for the cathodic cells.

The strip to be treated is subjected to 20 alternate cycles of cathodic and anodic polarity.

40 elementary cells according to the invention are therefore employed in this device and the strip functions alternately as anode and as cathode in these.

The electrolyte is an aqueous solution of sodium sulphate, concentration 200 g/l at a temperature of 85° C., with a pH of 7.0.

Under these conditions, strip velocities from 120 to 160 m/min were tried with current densities between 75 and 100 A/dm$^2$. In every case the strip turned out perfectly pickled, with a clean bright surface markedly resistant to rusting during the storage period.

Under the same conditions but with a lower number of cells (four pairs of elementary anodic-cathodic cells) the surfaces of cold-rolled mild steel strip, low alloy steel and micro-alloy steel strip were prepared for coating by light pickling and activation of the surface.

The treatment lasts between 0.25 and 4 seconds.

The results in terms of cleanness and surface quality of the strip were excellent in this case, too.

EXAMPLE 2.

Cold-rolled annealed and skinpassed strip, preferably pretreated as per the previous example, was electrolytically galvanized.

The treatment solution contains from 60 to 80 g/l of zinc ions in acid aqueous solution at pH between 0 and 2, and is at temperatures between 40° to 60° C.

Many trials were carried out in the range of condition described above. In this case the strip always functions as a cathode while the anodes, insoluble, are made of lead alloy.

The plant consists of 24 elementary cells in series.

Under each of the conditions tested, with a fixed strip velocity of 90 m/min, and using current densities of 100, 120 and 135 A/dm$^2$, uniform and compact zinc deposits of 7, 8.5 and 9.5 $\mu$m respectively were obtained, corresponding to about 50, 60 and 70 g/m$^2$.

From the results obtained it can be seen that, thanks to the rapid circulation of the solution in the deposition cells, the influence of changes in the concentration and temperature of the electrolyte is kept within very narrow limits.

EXAMPLE 3

A strip of galvanized steel, preferably prepared according to the above example, is subjected, according to the invention, to further coating with successive layers of metallic chromium and chromium oxides.

The coating process is carried out in two successive stages. These require two and four elementary cells respectively, in series.

The anodes of the said cells are all of the insoluble type, of lead alloy. The operating conditions in the first stage cells were as follows: the composition of the electrolyte was $CrO_3$ 115 g/l; NaF 1.73 g/l; $H_2SO_4$0.5 ml/l; $HBF_4$ 0.5 ml/l. The pH was below 0.8, the temperature 45° C. and the current density 85 A/dm$^2$.

Under these conditions, with a strip velocity of 50 m/min, 0.45 g/m$^2$ of chromium was deposited.

The operating conditions in the second stage 4 cells were as follows: the composition of the electrolyte was $CrO_3$ 40 g/l; NaF 1.73 g/l; $HBF_4$ 0.5 ml/l. The pH was 3, the temperature 30° C. and the current density 40 A/dm$^2$.

With a strip velocity of 50 m/min, 0.05 g/m$^2$ of chromium was deposited as oxide.

In the event that it is desired to coat only one face of the strip, it is sufficient to replace one of the anodes, for example the lower one, 3', with an insulating plate which extends within the chamber 10 to touch the lower face of the strip 6, thus shielding it, especially at the edges, from current dispersion at the edges.

I claim:

1. A device for the continuous electrolytic treatment of metal strip, in which the elementary electrolytic treatment cell consists of a hollow chamber of rectangular section, through which the strip to be treated passes, and which has insoluble electrodes on both its larger faces, the electrical circuit being closed through the metal strip to be treated, characterized in that said elementary cell is immersed in the electrolyte, the forced flow of which within the treatment chamber is ensured by an ejector, the ejector is at the end of the cell the strip to be treated enters, the ejector feeds fresh electrolyte in a direction opposite the direction of strip movement thereby drawing electrolyte at high speed from the other end of the cell through the treatment chamber, and the treatment chamber is open at both ends to the free flow of electrolyte therethrough.

* * * * *